US010118736B2

(12) United States Patent
Grosse-Heitmeyer et al.

(10) Patent No.: US 10,118,736 B2
(45) Date of Patent: Nov. 6, 2018

(54) BAG AND METHOD FOR PRODUCING THE SAME

(75) Inventors: Rüdiger Grosse-Heitmeyer, Westerkappeln (DE); Thomas Knoke, Bielefeld (DE); Martin Koelker, Ibbenbueren (DE); Ludger Schulten, Hopsten (DE); Hans-Ludwig Voss, Tecklenburg (DE); Jan Thorsten Weber, Lengerich (DE); Thomas Hawighorst, Hasbergen (DE); Holger Frische, Hasbergen (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 627 days.

(21) Appl. No.: 12/223,468

(22) PCT Filed: Jan. 2, 2007

(86) PCT No.: PCT/EP2007/000151
§ 371 (c)(1),
(2), (4) Date: Jul. 31, 2008

(87) PCT Pub. No.: WO2007/087965
PCT Pub. Date: Aug. 9, 2007

(65) Prior Publication Data

US 2009/0052813 A1 Feb. 26, 2009

(30) Foreign Application Priority Data

Jan. 31, 2006 (DE) ..... 10 2006 004 291

(51) Int. Cl.
*B65D 33/01* (2006.01)
*B65B 9/10* (2006.01)
(Continued)

(52) U.S. Cl.
CPC ..... *B65D 33/01* (2013.01); *B31B 70/00* (2017.08); *B65B 9/10* (2013.01); *B31B 70/857* (2017.08);
(Continued)

(58) Field of Classification Search
CPC ... B65D 33/01; B65D 77/225; B65D 2205/00
(Continued)

(56) References Cited

U.S. PATENT DOCUMENTS 4,134,535 A * 1/1979 Barthels et al. ..... 383/102
4,470,153 A * 9/1984 Kenan ..... 383/101
(Continued)

FOREIGN PATENT DOCUMENTS

BE 779679 8/1972
DE 298 07 807 U1 8/1999
(Continued)

*Primary Examiner* — Christopher Demeree
(74) *Attorney, Agent, or Firm* — Jacobson Holman, PLLC.

(57) ABSTRACT

A sack is formed by first transverse sealing seams from a foil tube, and is provided with at least a first vent channel, which runs largely parallel to the axis of the film tube, and whose inner film layer has first vent openings for venting of the sack interior into the first vent channel. A second vent channel is provided, which is connected to the first vent channel by second vent openings, and which, in turn, has third vent openings, which vent the at least one second vent channel.

16 Claims, 17 Drawing Sheets

(51) Int. Cl.

| | |
|---|---|
| ***B31B 70/00*** | (2017.01) |
| *B31B 160/10* | (2017.01) |
| *B31B 155/00* | (2017.01) |
| *B31B 70/855* | (2017.01) |

(52) U.S. Cl.
CPC ..... *B31B 2155/00* (2017.08); *B31B 2155/003* (2017.08); *B31B 2160/10* (2017.08)

(58) Field of Classification Search
USPC ..... 383/101
See application file for complete search history.

(56) References Cited

U.S. PATENT DOCUMENTS

| | | | | |
|---|---|---|---|---|
| 4,550,546 | A * | 11/1985 | Raley et al. | 53/425 |
| 5,553,942 | A | 9/1996 | Domke et al. | |
| 6,170,985 | B1 | 1/2001 | Shabram, Jr. et al. | |
| 6,460,317 | B1 | 10/2002 | Voss | |
| 6,491,433 | B2 * | 12/2002 | Shabram et al. | 383/100 |
| 2004/0096128 | A1 * | 5/2004 | Shibata | 383/101 |
| 2005/0281493 | A1 | 12/2005 | Heinemeier et al. | |

FOREIGN PATENT DOCUMENTS

| | | | |
|---|---|---|---|
| DE | 199 20 478 | A1 | 11/2000 |
| EP | 0 768 245 | A1 | 4/1997 |
| EP | 1 600 399 | A1 | 11/2005 |
| EP | 1 607 339 | A1 | 12/2005 |

* cited by examiner

Schnitt C-C

BAG AND METHOD FOR PRODUCING THE SAME

CROSS-REFERENCE TO RELATED APPLICATION

This is a national stage of PCT/EP07/000151 filed Jan. 2, 2007 and published in German.

BACKGROUND OF THE INVENTION

1. Field of Invention

The invention concerns a sack and a sack production method.

2. Description of the Prior Art

Sacks, produced and filled according to the so-called FFS method (FFS—form fill and seal), are known. This method is described in DE 199 204 78. Here a film tube is first unwound by an unwinding device and fed to an FFS machine, in which the film tube is initially separated into sacks by transverse separation welds. These sacks are grasped by appropriate gripping devices, filled at a filling station, closed by another transverse sealing and discharged from the machine as filled and closed sacks. A trend has also recently been witnessed in packing increasingly finer bulk products in sacks. Especially when the packaging process of such products is carried out by an FFS machine, which fills the material being packed very quickly into the sack, in which case the material can be exposed by freefall movement over a certain path, relatively considerable surrounding air is entrained into the sack by the material being packed. This air is initially enclosed in the sack by the process of sealing the sack.

However, a frequently pursued goal in the technical world is to vent the sack interiors and leave as little air as possible in the product filled in the sack. For this purpose, sacks are generally provided with perforations. However, such perforations or holes in the sack outside wall have the drawback that they lead to escape of especially fine filled material.

For this reason, EP 1 600 399 A1 proposes to propose a sack with a vent channel formed from two film layers. One film layer has first vent openings to the sack interior and the other has second vent openings to the atmosphere.

SUMMARY OF THE INVENTION

The task of the present invention is to propose a sack, in which the ratio between ventability and possible loss of filled material is improved in the closed state.

This task is solved in that at least a second vent channel is provided, which is connected to the first channel by second vent openings, and which, in turn, has three vent openings that vent at least a second vent channel. This type of sack is surprisingly easy to produce.

Through this expedient, the direct connections of the first vent channel to the atmosphere (perforation of the outer film layer) can often be saved without reducing the ventability of the sack below the required amount. As an alternative, the outer film layer can be equipped with a perforation that is less permeable than the first film layer.

The vent channel of the sack according to the invention is generally formed by a double film layer parallel to the tube axis of the sack. For this purpose, the double layer can be formed already during tube formation. The boundaries of the at least first vent channel are then advantageously defined by longitudinal welds, which can be introduced by appropriate sealing devices already during tube formation. If the tube is formed from a flat film by means of a longitudinal sealing seam, only a second seam running parallel to this first sealing seam is required, in order to define such a channel. The term vent channel according to the present application, however, is understood to mean any design of sack components that are appropriate to guide air from the sack interior to additional vent openings that can also lead to an additional vent channel. Generally, such vent channels have greater length than width and are formed from double film layers.

According to the invention, in addition to the at least one first vent channel, at least one second vent channel is provided. The number sequence, first, second and later third vent channel, is guided according to the sequence, in which the air escaping from the sack interior traverses the channel on its path to the atmosphere, i.e., the outer space. The at least one second vent channel thus generally has areas without direct connections to the sack interior. In this way, the connections to the sack interior from the venting openings to the atmosphere are spaced along the sack surface, which increases tightness. Direct connections to the sack interior in the at least one second vent channel are preferably either no longer present at all or limited to areas in which the axes of the first and second channels intersect. The same applies for the third and additional vent channels in relation to the second. A vent channel is an at least partially bounded space.

For example, in a case in which at least a first vent channel runs parallel to the tube axis and the second runs orthogonal to it, in the intersection area of the two channels, only vent openings either from the first to the second or from the second to the third channel or to the atmosphere should be present. If, in the intersection area or in the vicinity, there are vent openings from the first to the second channel, it is advantageous to space the openings from the second to the third channel or to the atmosphere. Optionally, the gusset area can be used for this purpose. With reference to designation of the vent openings with ordinal numbers, a situation similar to the vent channels applies:

The connection openings between the sack interior and the at least one first vent channel are the first vent openings, the connections between the at least one first vent channel to the at least second vent channel are the second vent openings and so forth.

If the at least one first vent channel runs parallel to the at least one second vent channel, it is advantageous that the longitudinal sealing seams required to form the two channels are already introduced during tube formation in double film layers. The vent openings connecting the first and second channels should then be configured as interruptions of this sealing seam.

Another advantageous possibility is a largely orthogonal arrangement of the first and second channels relative to each other. It is clear that manufacturing tolerances, but also acute angles between the channel axes, are still covered with the word "largely". It is particularly advantageous to provide channels on a sack end, so that a wall or limitation of the corresponding channel can already be formed from final sealing. The other wall can then be formed by transverse sealing. Such channels can be first, second or even third vent channels.

The other sack end can be configured in the same way. Generally, symmetric sack designs are to be preferred.

As already mentioned, interruptions in separating weld seams are considered for vent openings.

Additional advantageous vent openings are holes that can be produced by punching and perforations. Microperforations are also often advantageous.

For purposes of the present invention, "microperforation" is mostly understood to mean perforations, whose diameter is smaller than the average or smallest particle size of the filled product.

Filters or valves can be introduced to the vent openings. Filter here is understood to mean all types of felt-like or fabric-like material, whether woven or non-woven, which is air-permeable, on the one hand, but can retain dust-like solids, on the other.

The production of a sack according to the invention can be advantageously combined in a variety of ways with elements of the FFS method. However, it has proven advantageous in experiments that the vent channels extending along the tube axis are produced during tube formation on a tube former. If sacks with a second vent channel running largely parallel to the first channel are then produced, there is the possibility of applying the transverse seams necessary for this purpose on the tube former or FFS machine. Since the FFS machine operates at least partially intermittently, it is better to form the transverse sealing seams here. This can occur by an advantageous (double) sealing die.

Additional practical examples of the invention follow from the description and claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
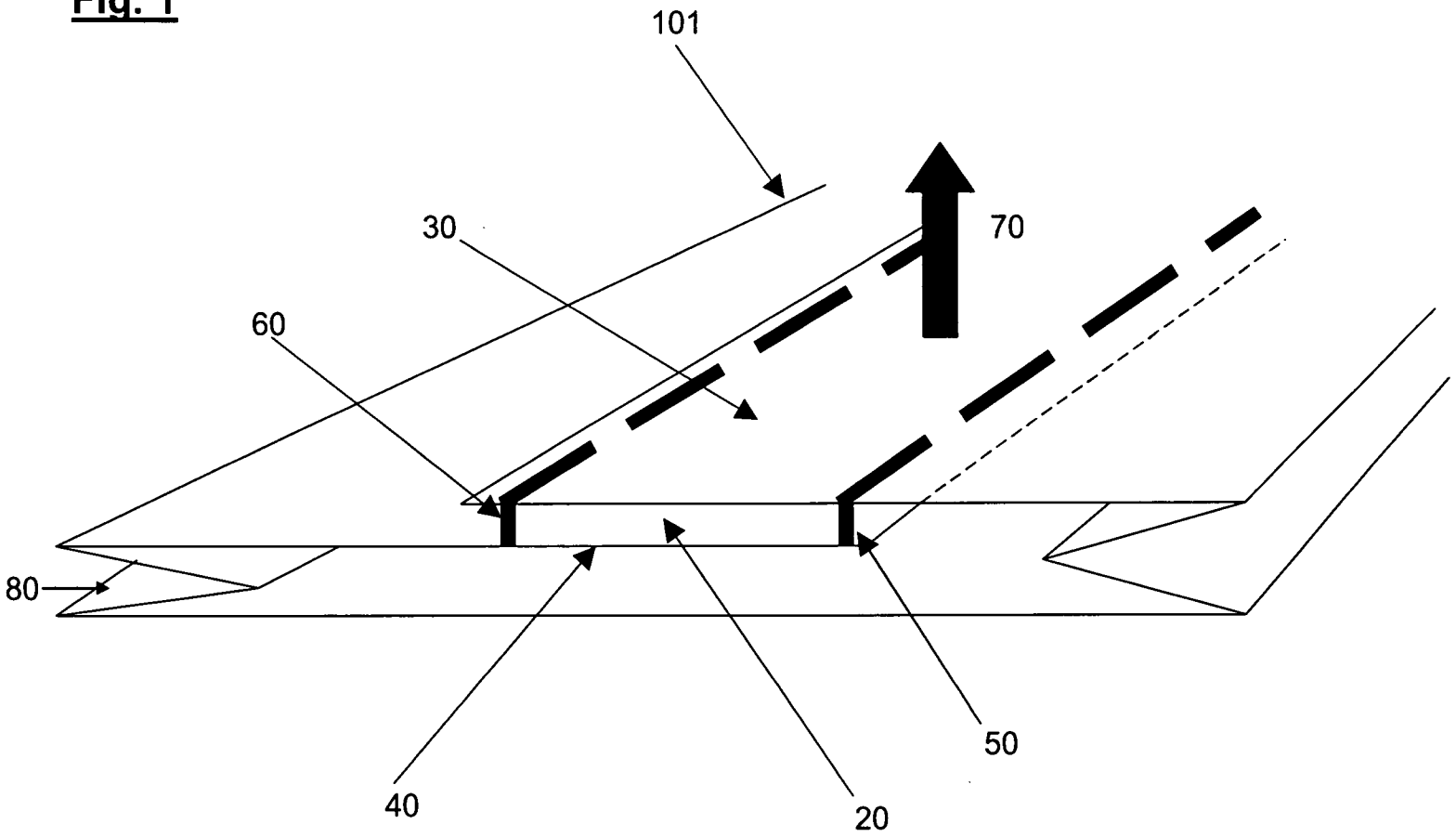
FIG. 1 Sketch of a tube piece 1

FIG. 1 shows a tube piece 101, from which a sack 220 according to the invention can be produced. The tube piece 101 is formed by the first longitudinal weld 60 from a flat film. The first vent channel 20 is formed by the first longitudinal weld 60 and the second longitudinal weld 50. The outer limitation wall 30 of this channel 20 in the present example can have microperforations (not shown). In this case, the inner limitation wall (also inner film layer) 40 has larger perforations than the aforementioned microperforations. Arrow 70 indicates that air can escape through the aforementioned microperforations. The sack interior 210 is used to store a filled product (not shown).

Figure 2:
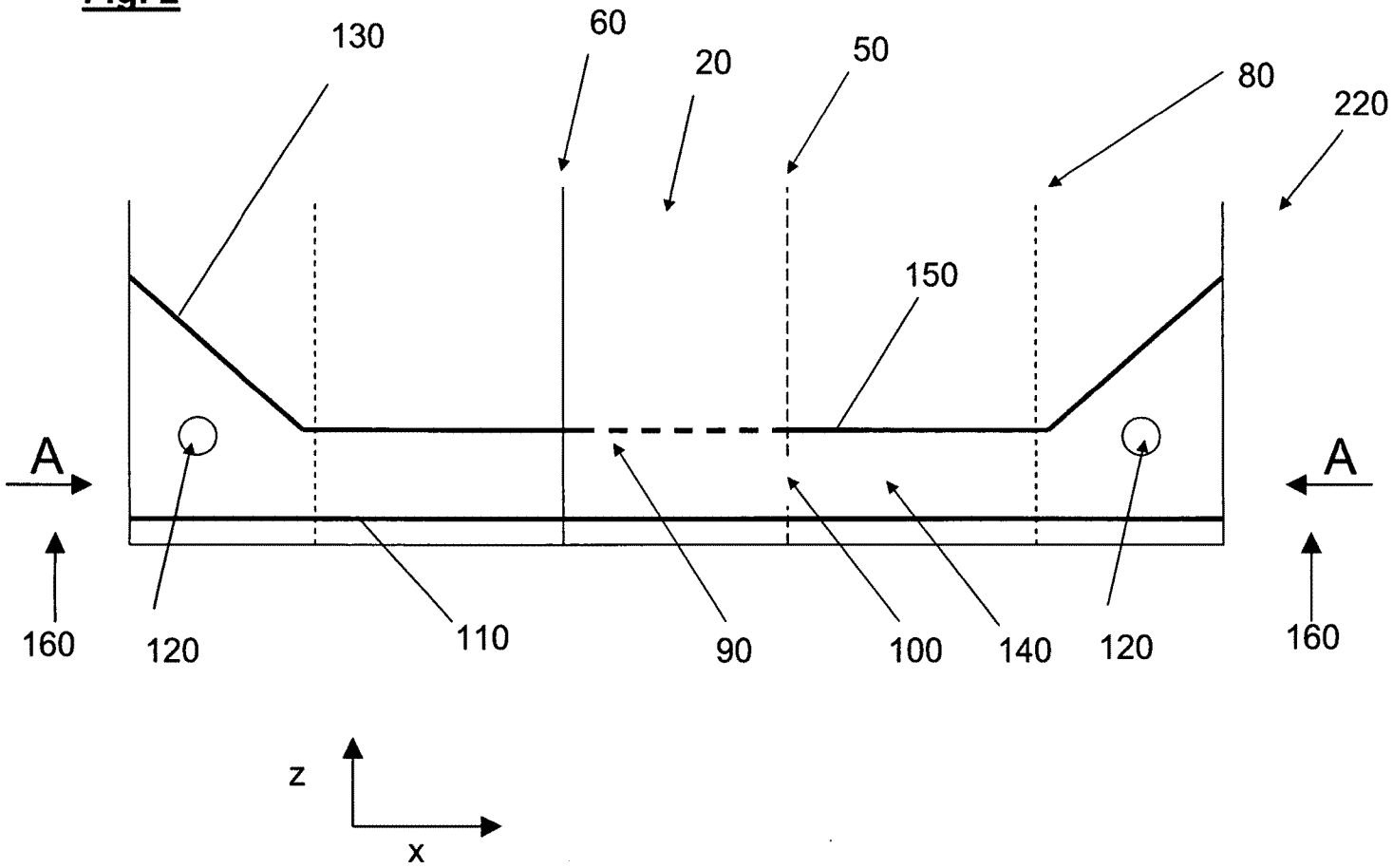
FIG. 2 The end of a first practical example of a sack according to the invention FIG. 3 Section A-A from FIG. 2

FIG. 2 shows an end of a sack 220 according to the invention. A first vent channel is again formed by the longitudinal weld seams 50 and 60. This first channel discharges via vent openings 90 into the second vent channel 140, which is formed by end sealing 110 and additional transverse sealing 150. The additional sealing 150 on the edges of the sack also assumes the function of corner sealing 130. The present sack is vented relative to the atmosphere mostly in the area of the gussets 80 through needle punch 120, which is far removed from the intersection area between the first 20 and second channel 140. The two channels are joined to each other by vent openings 90 and 100. These are brought about by interruption of the sealing seams 50 and 150. Such interruptions can be brought about by correspondingly shaped or controlled sealing dies and/or corresponding coating of the film components, which are not to be sealed flat.

Figure 3:
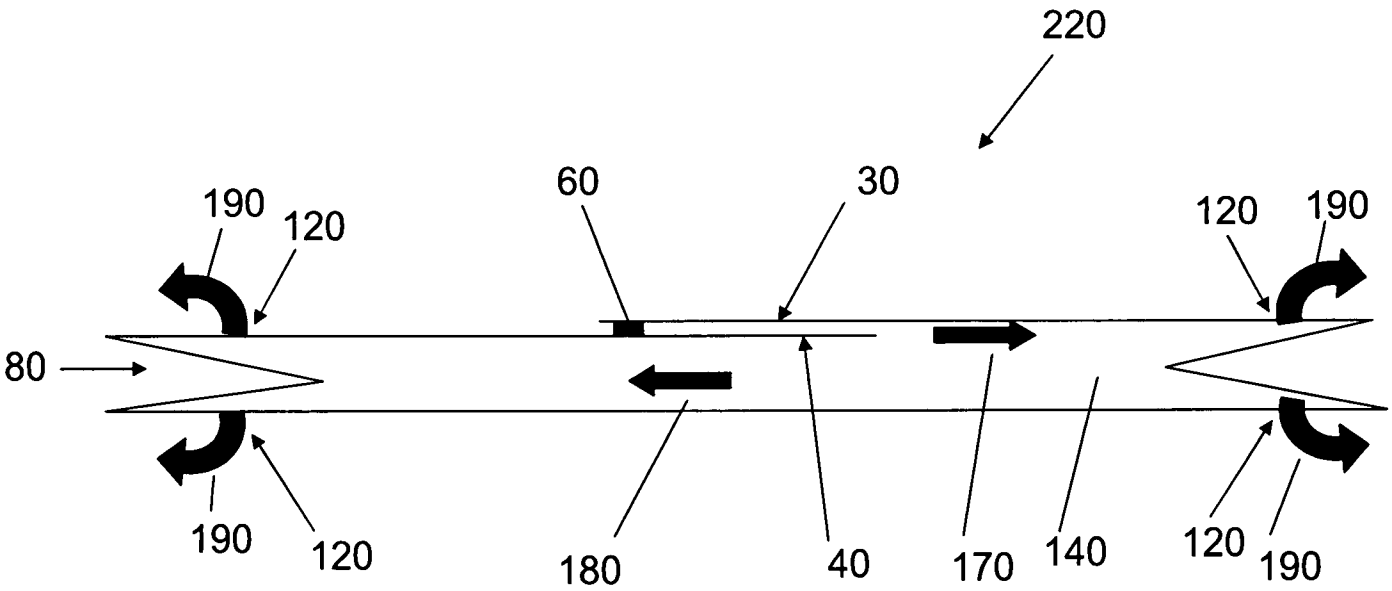

FIG. 3 shows section A-A from FIG. 2 from the viewing direction shown by arrow 160, in which elements behind the cross-sectional plane could not be shown, for drawing reasons. In this sectional view, the effect of interruption of the sealed seam 50 can be seen even more clearly. The air then flows along arrow 170 from the overlapping area of limitation walls 30 and 40 into the second vent channel 140. The air then goes to the third vent openings 120 along arrows 170 and 180, through which it then escapes into the atmosphere along arrow 190.

Figure 4:
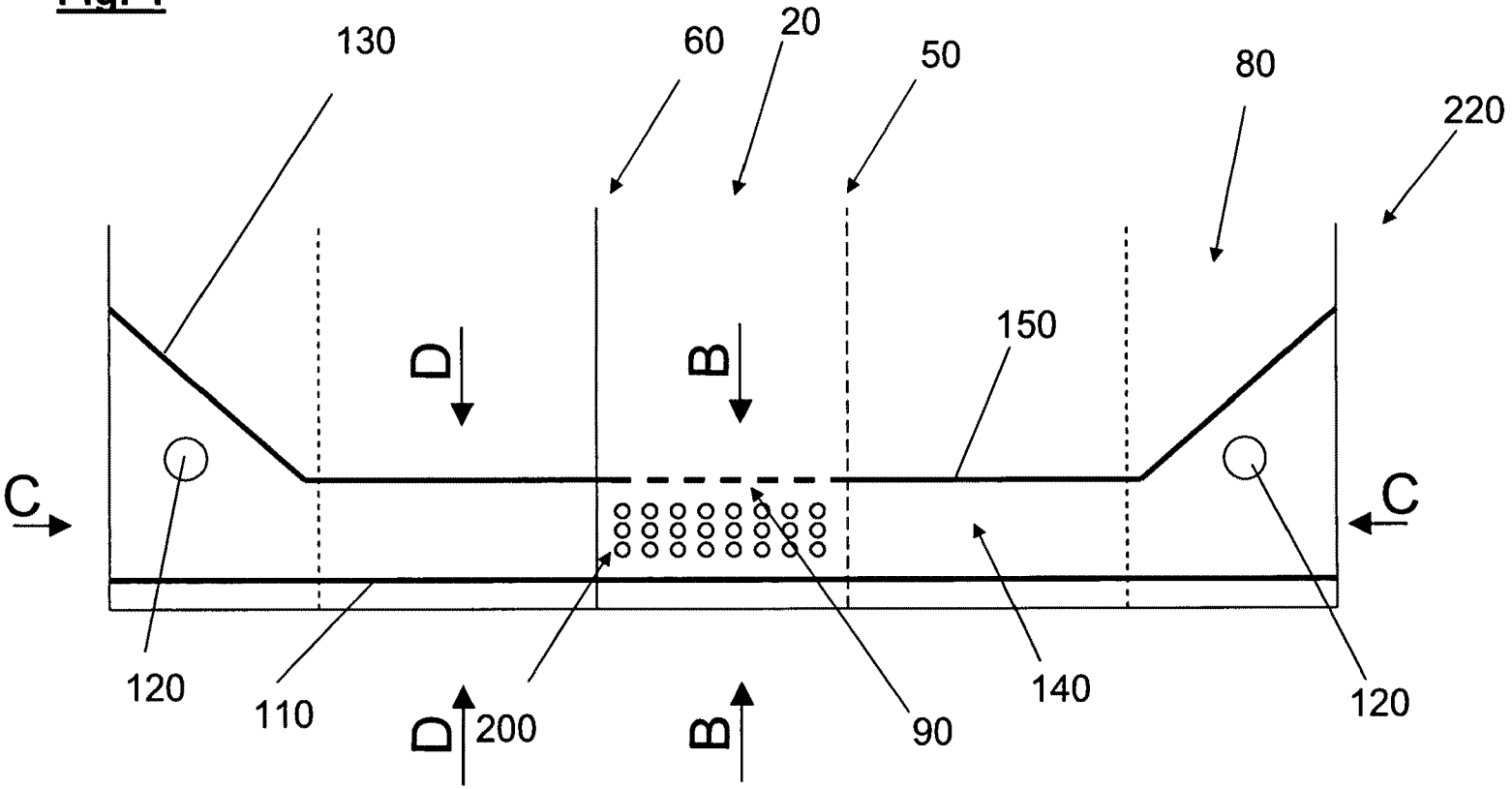
FIG. 4 The end of a second practical example of a sack according to the invention FIG. 5 Section D-D from FIG. 4

FIG. 4 shows a sack end, in which only the vent openings are configured differently than in the practical example depicted in FIGS. 2 and 3, in which the connection between the first 20 and the second vent channel 140 is formed from interruptions 90 of the weld seams 150 and 50 to also be referred to as second vent openings. There are also interruptions in the weld seam 150 in FIG. 4, which expand the first vent channel 20 into the area by the second vent channel 140. The film material in this overlapping area between the two vent channels 20 and 140 is perforated by openings 200, so that the channel 20 is vented into the second channel 140 through these openings 200 and the interruptions 90 of the weld seam (see also FIG. 7). Final venting of the second channel 140 to the atmosphere again occurs through needle punch 120.

Figure 6:
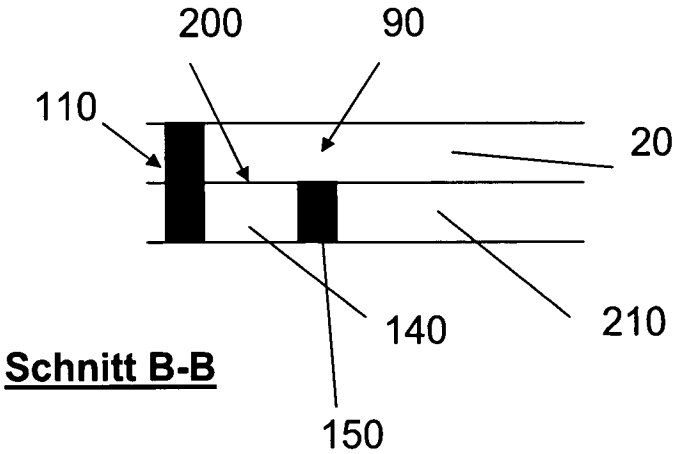
FIG. 6 Section B-B from FIG. 4
Figure 5:
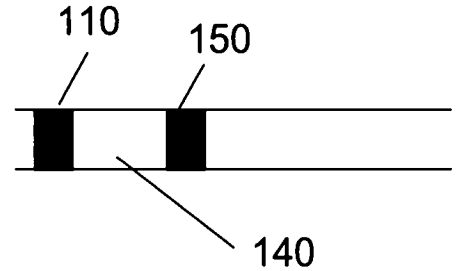
Figure 7:
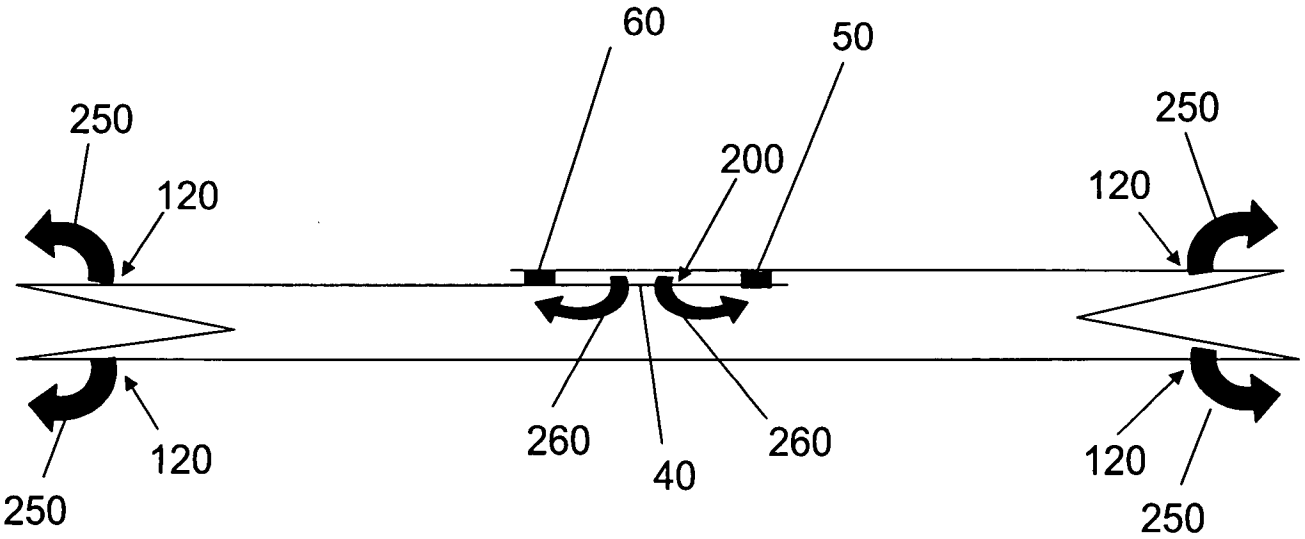
FIG. 7 Section C-C from FIG. 4

FIGS. 5 to 7 contain sectional views from FIG. 4. FIG. 5 shows section D-D from FIG. 5 [sic], which merely shows that the second vent channel 140 is arranged between the head seam 11 and the additional transverse weld seam 15. Section B-B from FIG. 4 is shown in FIG. 6, which shows the overlapping area between the two vent channels 20 and 140. The openings 200 can again be indicated only by arrow and reference number. The sack interior is provided with reference number 210. The interruptions of the weld seam 150 are again indicated with arrow 9. Objects behind the cross-sectional plane were not depicted.

Section C-C from FIG. 4 is shown in FIG. 7, in which the arrows 260 symbolize air flow in the second vent channel 140, which comes about by the air flow through the openings 200 introduced in the inner limitation wall 40, but not further shown here. The arrows 250 symbolize air flow from the outlet openings 120 to the atmosphere.

Both ends of the sack can naturally also be equipped with the depicted sack ends.

First vent openings according to the present document, that is, vent openings that connect the sack interior 210 and the first vent channel 20 to each other, are not shown in the figures, for drawing reasons. Showing advantageous needle punch, perforation or microperforation of the outer limitation wall 30 of the first vent channel was also dispensed with.

Figure 8:
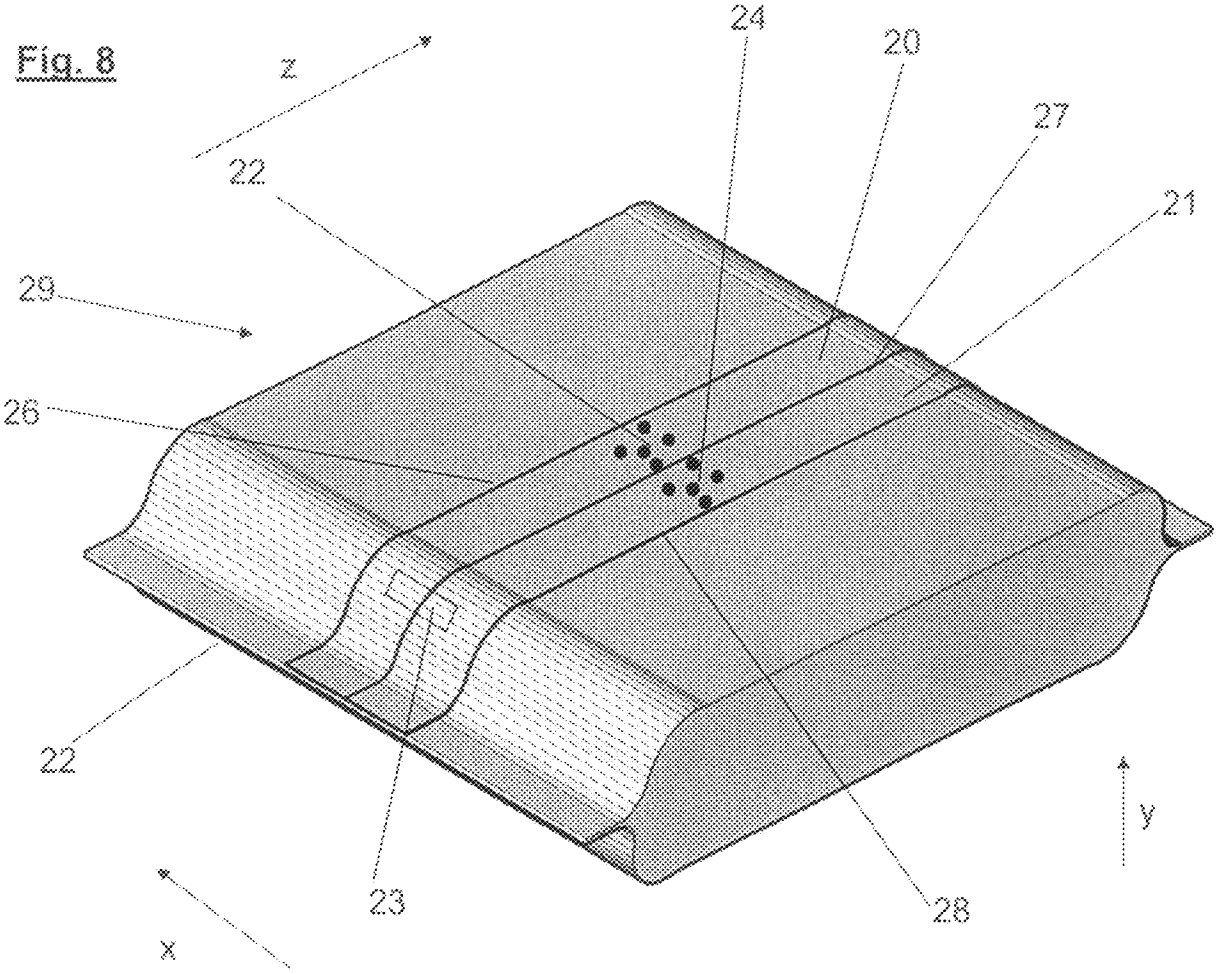
FIG. 8 A sketch of a sack with two parallel vent channels

FIG. 8 shows another variant of a sack 29 according to the invention, in which the two largely parallel vent channels 20 and 21 are provided, which are bounded by longitudinal seams 26, 27 and 28. The first vent channel 20 is connected to the sack interior via the first vent openings 22 and is vented, in turn, via the second vent openings 23, indicated by the rectangle 23, into the second vent channel 21. This vent channel 21 has vent openings 24 to the atmosphere. The sack 29 is formed from a tube piece and closed via end seals 25. As is common in sacks, the sack is stacked preferably on a surface thereof formed by the sack width x and sack length z (along the tube axis). If this occurs, a height offset between the first and third vent openings 22 and 24 and the second vent openings 23 occurs.

Figure 9:
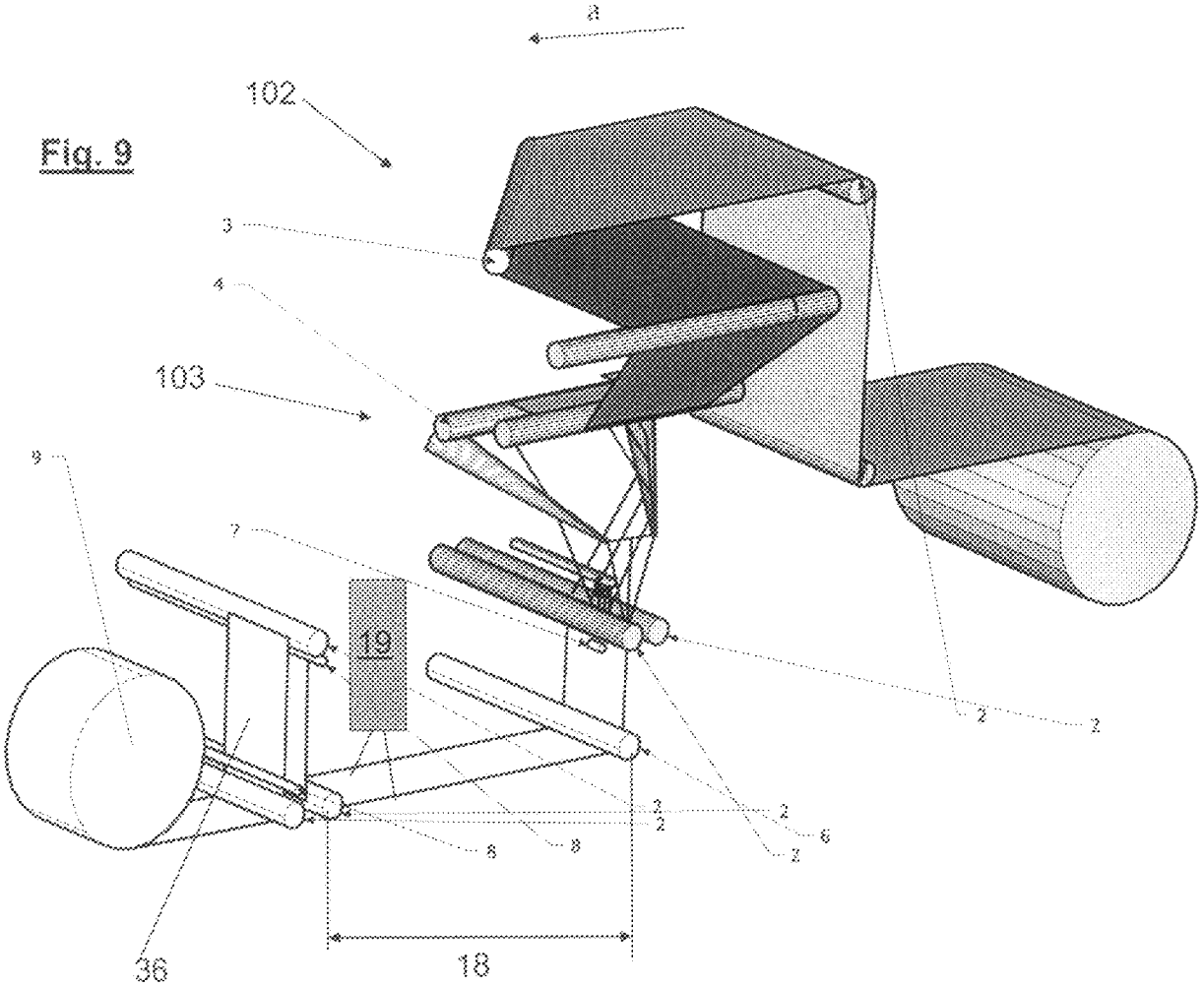
FIG. 9 A first sketch of a tube former
Figure 14:
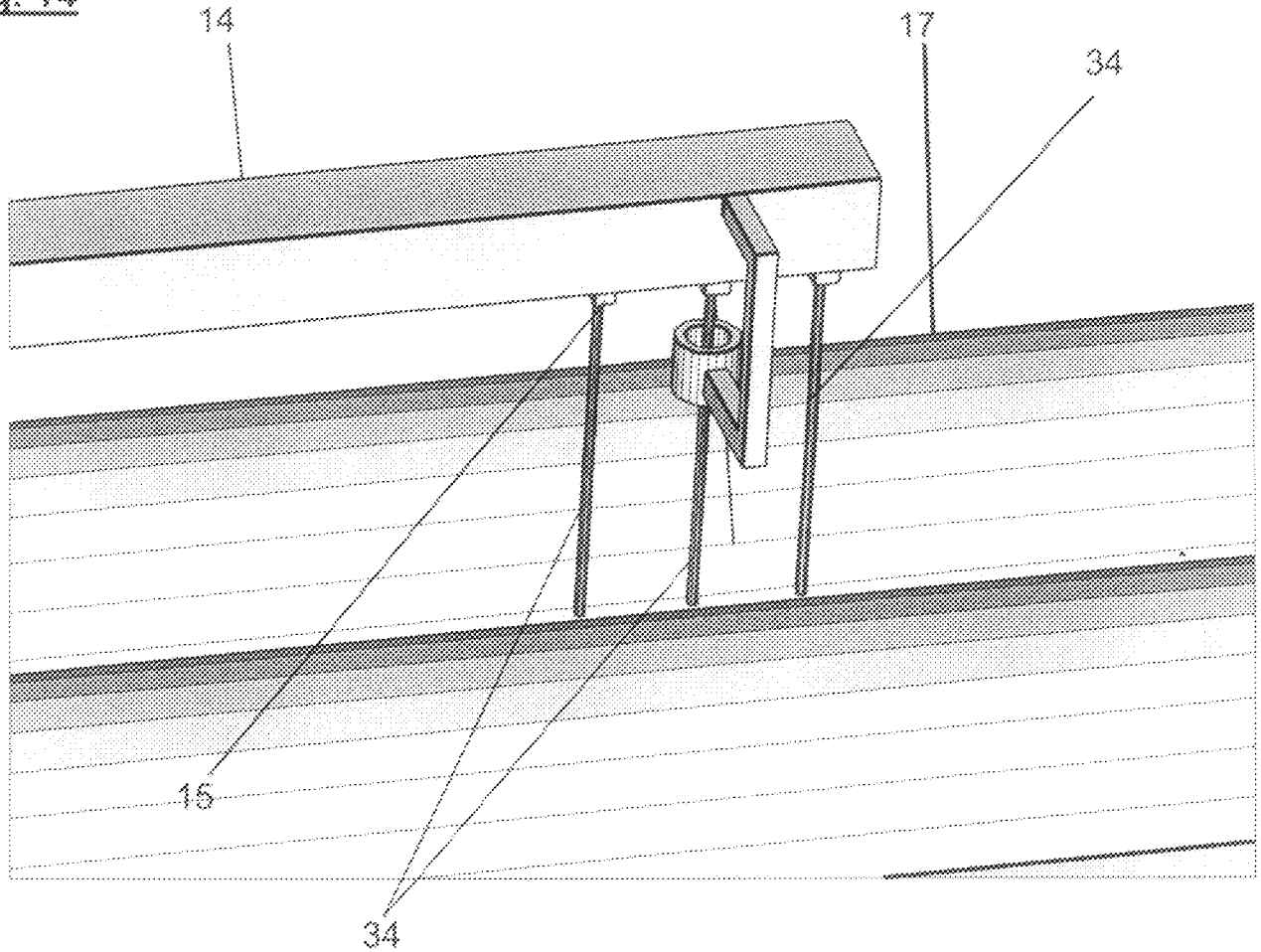

Devices for formation of tubes and assemblies of these devices are shown in FIGS. 9 and 14. This device is advantageously suited for production of tubes that can be the starting point for production of sacks according to the invention.

Packaging is advantageously produced by a folding process from a flat web with subsequent application of the longitudinal seam in the overlapping area. In order to pack dusty products in this packaging, it is important to vent the sack after sealing. This venting can occur through a labyrinth vent. This labyrinth vent is produced by overlapping, which is sealed with two seams.

In the inner layer of this overlapping, an access to the interior of the packaging is produced by openings. The air can then penetrate into this area and, as is known, penetrate outward through openings in the enclosing weld seams. Openings in the outer layer that permit outflow of the air, offset in height to the opening in the inner layer, are also known.

Overall, both possibilities have in common that the path between the first opening and the second opening can amount to a maximum of one sack length. It is therefore advantageous to increase this path by expedients and hamper penetration of water or escape of the packed product.

Figure 10:
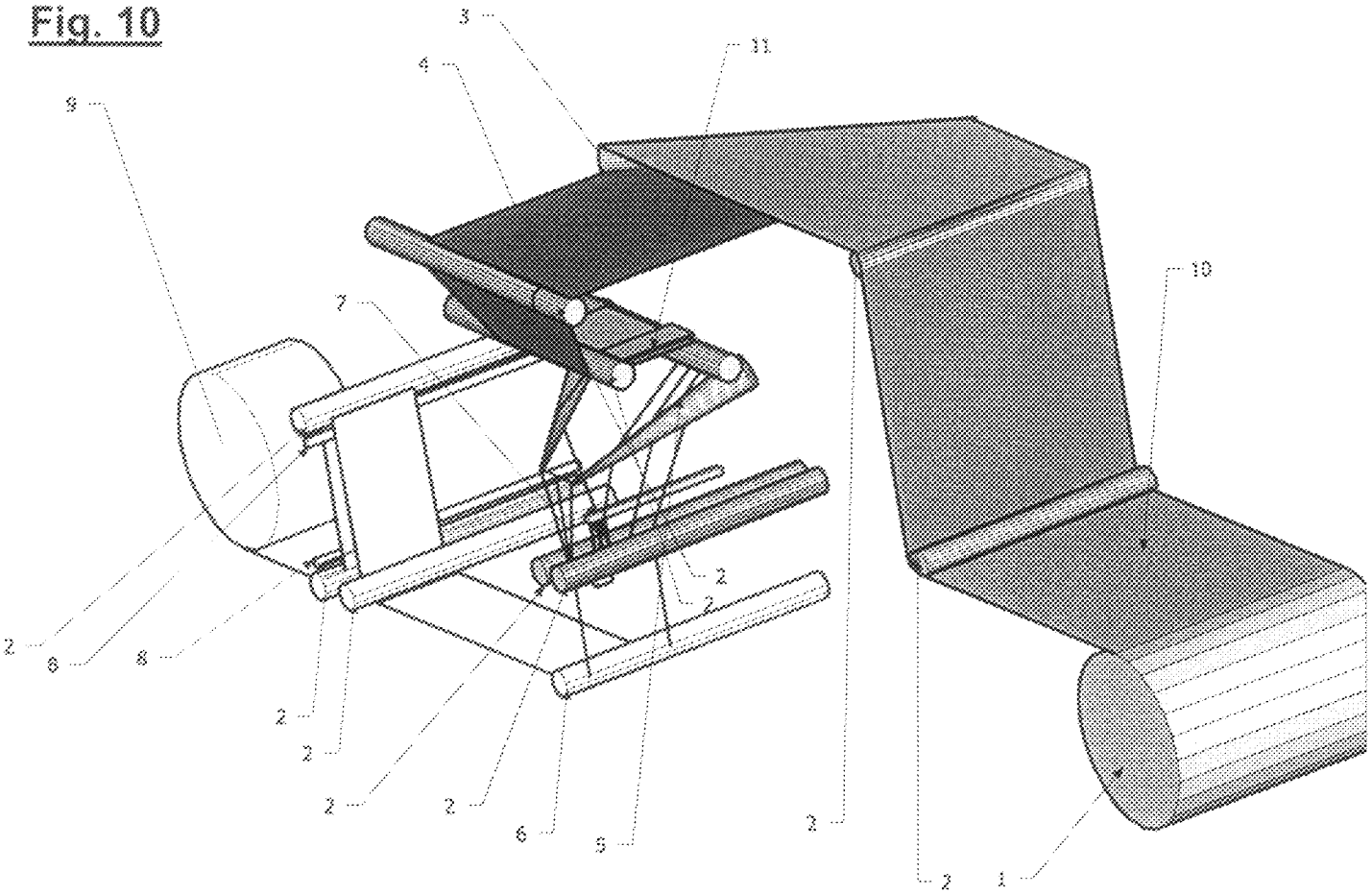
FIG. 10 A second sketch of a tube former from FIG. 9 from a different viewing angle FIG. 11 The components of the tube former that form the first gusset FIG. 12 The components of the tube former that form the second gusset FIG. 13 The components of the tube former that form the longitudinal seams FIG. 14 The components of the tube former that form the longitudinal seams from a different viewing angle FIG. 15 Another practical example of a sack 29 with only one vent channel 20

For production of packaging according to the above description, the device 102 described below could be used. The device is depicted in FIGS. 9 and 10 and constructed as follows.

Figure 11:
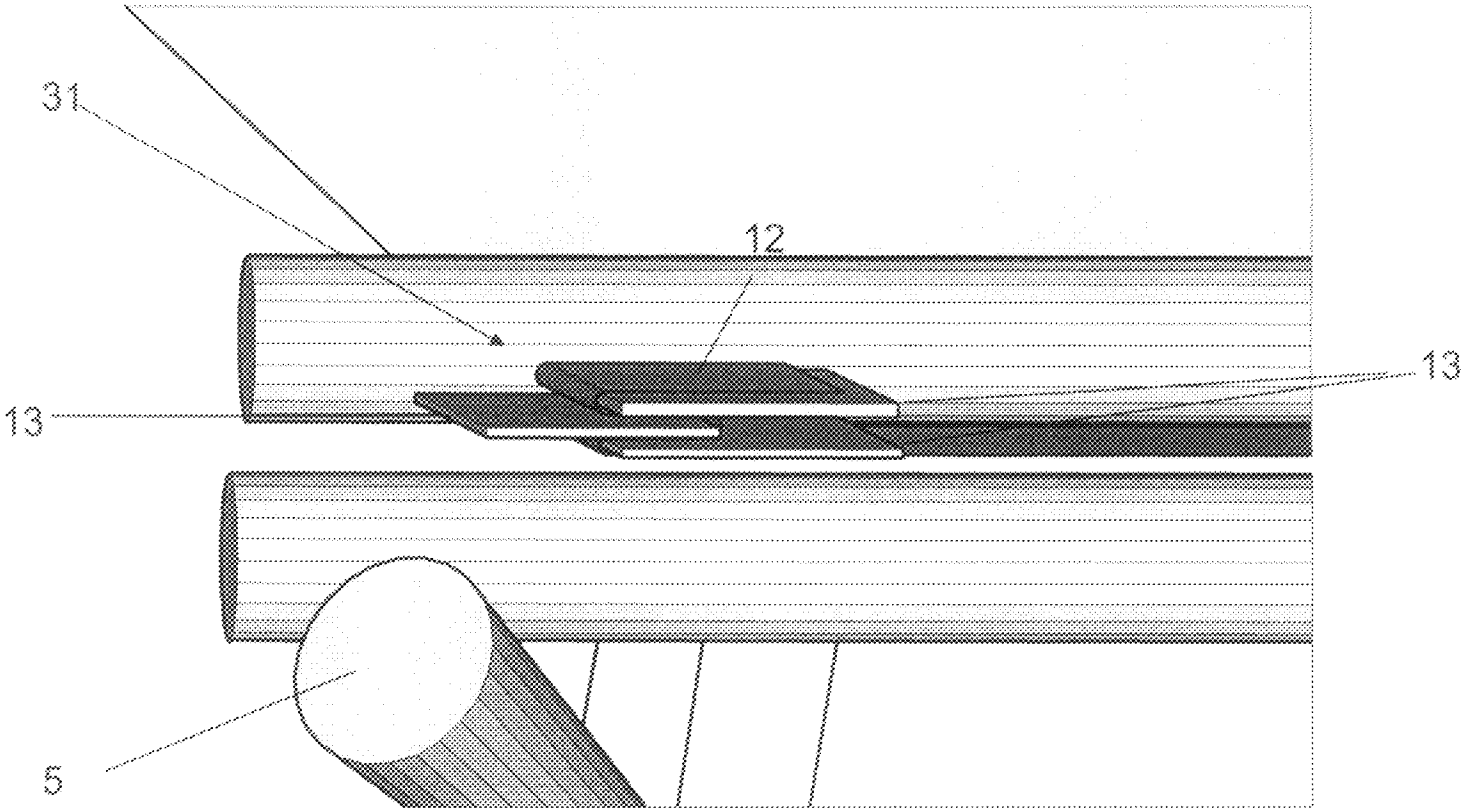

A flat web 10 of plastic is unwound by an unwinder 1. This flat web is guided via deflection rolls 2 to a deflection device 3. This deflection device consists of an air turner bar, which is mounted 45° to the unwinding device. The air turner bar is additionally provided with a device that makes it possible to move the air turner bar in the machine direction or across this direction. Because of this, side edge control is produced and the incoming web is always guided constantly into the device, i.e., even with rolls that are not straight-edged. After the air turner bar, the web runs across the machine direction and is fed via additional deflection rolls 2 to a device 11, which forms a first gusset 12. This gusset formation is designed according to FIG. 11 and has three flat guides 13 that provide the possibility on the surfaces touching the film for compressed air to escape via openings in the surface. Because of this, a reduction in friction between the film and die is produced, and therefore high processing speed is made possible without damaging the film or subjecting the dies to unduly severe wear.

Figure 12:
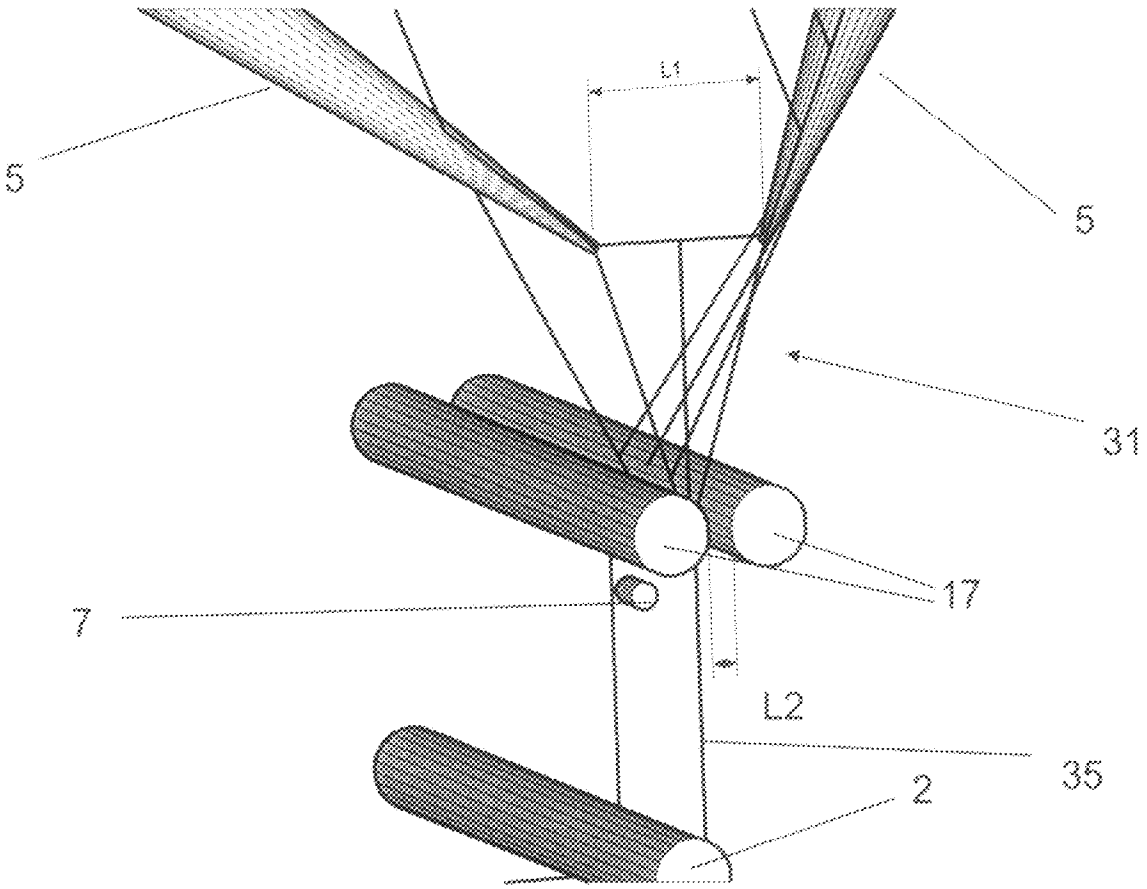

After this device, the film is fed with the first gusset inserted to an additional device 103 via a driven advance roll 4, which includes conical dies 5. These dies are also equipped with the capability of reducing friction via outflow of air. By means of these dies, the foil web is joined to a tube. On the pointed ends of the cone-like dies, the second gusset of the gusset tube is formed according to FIG. 12. It is advantageous, if the geometric condition $L1<L2$ applies.

In order to produce different gusset depths, the cones are designed movable along their axis of rotation.

Immediately after the cones, the tube is fed to two squeeze rolls 17. In the rear area, the tube is still open, until reaching the deflection rolls. This achieves a situation, in which a device for introduction of longitudinal seal gluing or sealing can be moved in the still open tube.

Figure 13:
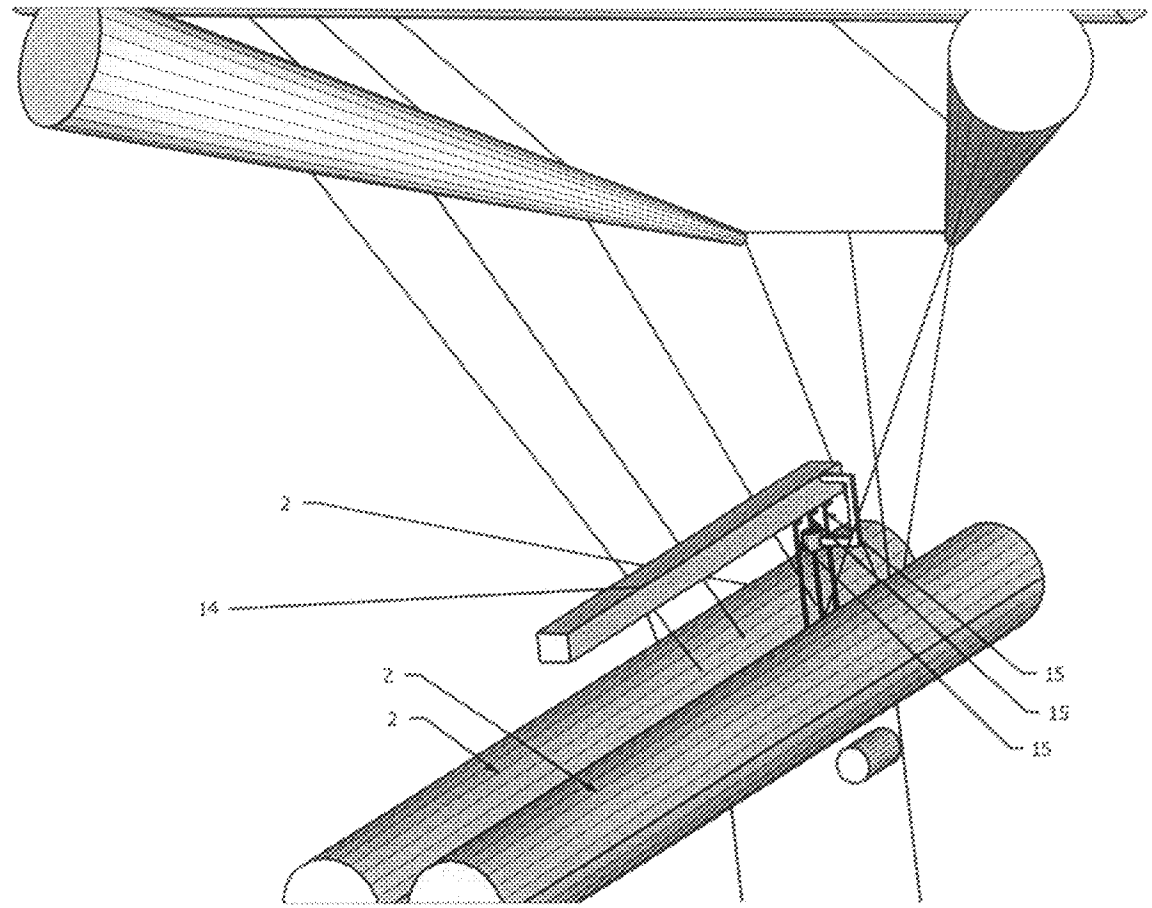

This device can be a longitudinal seam extruder 14, which is shown in FIG. 13 with the outlet area.

Through the longitudinal seam extruder, an extrudate is passed from at least one opening 15 at the site where the overlapping area was formed and therefore after the tube has passed the deflection rolls 2 to be closed. The just applied extrudate is cooled by means of a seam cooling roll 7 and the tube sealed.

The finished tube 35 is subsequently checked in a checking zone 18 by a measurement device. This measurement device 19 determines the temperature of the longitudinal seam 26, 27, 28 with an infrared camera. In the case of unduly large deviation from predetermined temperatures, a defected longitudinal seal can be assumed. An error is reported in such a case and the installation shut down.

A subsequent cooling zone 36 produces cooling of the seam to room temperature and permits subsequent winding with a corresponding winder 9. It has proven advantageous to guide the formed gusset tube before the larger deflections over so-called toothed rolls 8.

In order to produce the packaging just described (for example, sack 29 according to FIG. 8, or also FIGS. 15-17), in addition to the known two longitudinal seams, a third seam can be introduced as connector. This connector serves for separation between the channel, in which venting through the inner layer of the packaging occurs, and the channel, from which venting occurs outward. This connector is left open at an appropriate site and thus produces a channel length that reaches twice the sack length. The situation for production of three seams is depicted in FIG. 14. The molten strands 34 extruded by the extruder 14 through the extrusion nozzles 15 should be mentioned here. In this depiction, representation of film 10 was dispensed with.

Figure 15:
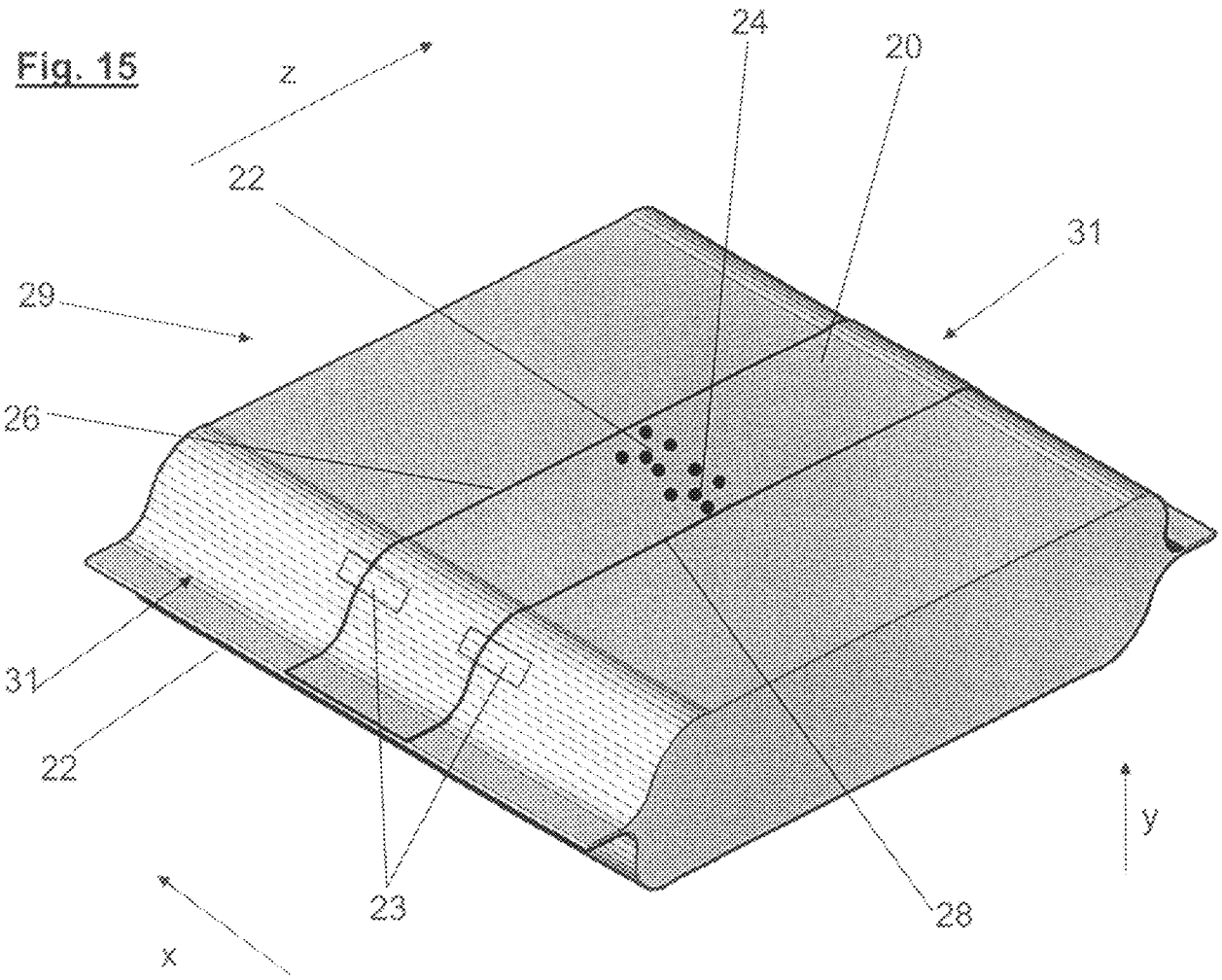

A sack with only one vent channel 20, which vents the sack interior via the first vent openings 22 and releases the air to the atmosphere via the second vent openings 23, which are configured as interruptions of seams 26, 28, is shown in FIG. 15. If the sack is in the stacked state, there is a height difference y between the first 22 and second vent openings 23. This sack can also be produced according to a method presented here or a device presented here.

Figure 16:
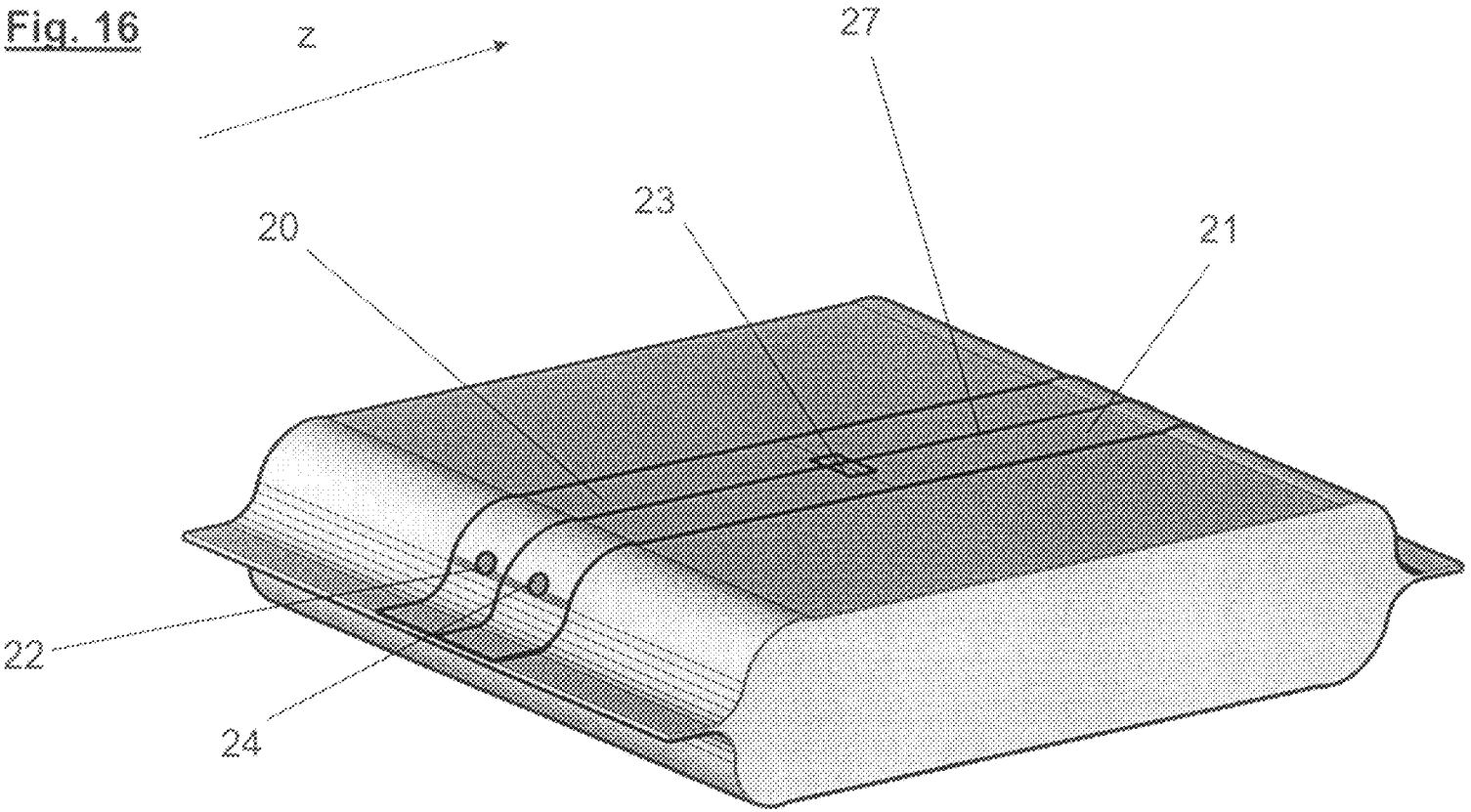
FIG. 16 A third practical example of a sack 29 with two vent channels 21 and 23
Figure 17:
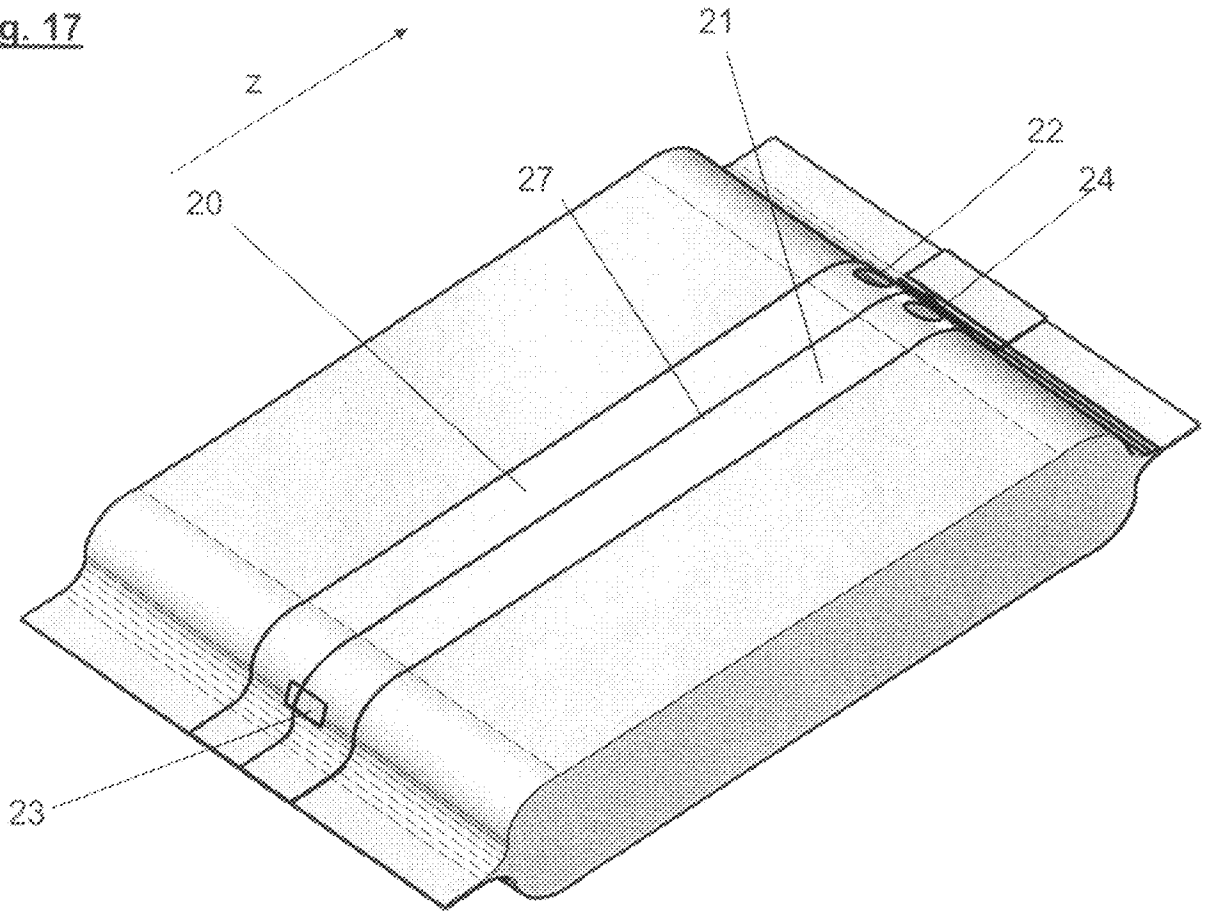
FIG. 17 A fourth practical example of a sack 29 with two vent channels 21 and 23

Two vent channels 20 and 21 are again present in FIG. 16. The different groups of vent openings 22, 23 and 24 again have the usual function. A sack according to the invention is also shown in FIG. 17, in which the reference numbers have the usual function.

Figure 18:
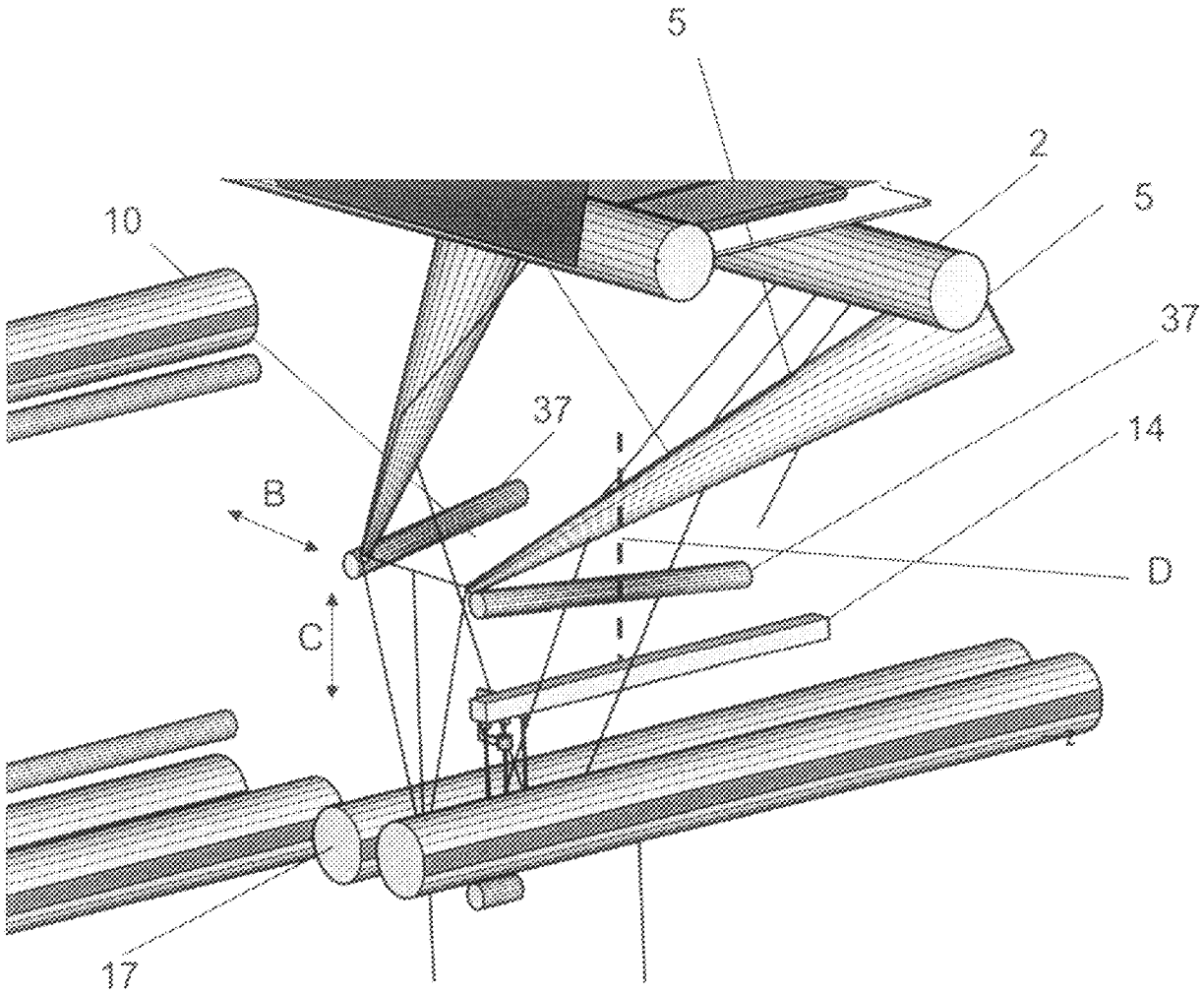
FIG. 18 A cutout of the sketch of the tube former with special rolls to prevent creasing

The position and adjustability of the additional guide rolls 37 is shown in FIG. 18. It can be adjusted in the transport direction of the film—here shown by arrow C. It can be setup in the direction of arrow B (two such rolls 37 exist in the figure, but also against the running film). An additional positively acting adjustment possibility is pivotability around axis D. This axis runs largely parallel to the film transport direction. The rolls 37 and their adjustment capabilities have proven to be positive in experiments for preventing creasing in the film tube.

The middle seam that produces the connector can be interrupted by applying a coating to the incoming web. Additional device features or means, with which an interruption can be produced, are:

1. Mechanical
   a. By an aperture or sheet with openings, which is moved with the proper frequency through the melting beam.
   b. Through an air nozzle that deflects the beam.
   c. Through a cold gas or air that cools the beam, so that no connection to the film can occur.
2. Chemical
   a. By spraying a substance that prevents bonding.
3. Electrical
   a. By pretreatment of the extrudate, which prevents bonding.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of Reference Numbers | |
|---|---|
| 101 | Tube piece |
| 20 | First vent channel |
| 30 | Outer limitation wall |
| 40 | Inner limitation wall |
| 50 | Second longitudinal seal |
| 60 | First longitudinal seal |
| 70 | Arrow in the direction of air flow |
| 80 | Gussets |
| 90 | Second vent openings |
| 100 | Second vent openings |
| 110 | End seal |
| 120 | Needle punch/punching/third vent opening |
| 130 | Corner sealing |
| 140 | Second vent channel |
| 150 | Transverse sealing/additional end sealing |
| 160 | Arrow in viewing direction of section A-A |
| 170 | Arrow in direction of air stream |
| 180 | Arrow in direction of air stream |
| 190 | Arrow in direction of air stream |
| 200 | Second vent opening/punching |
| 210 | Sack interiors |
| 220 | Sack |
| 230 | |
| 240 | |
| 250 | Arrow in direction of air stream |
| 260 | Arrow in direction of air stream |
| 21 | Second veny channel, running essentially parallel to the first 20 |
| 22 | First vent openings (sack interior-firsy channel 2) |
| 23 | Second vent openings between first and second vent channel |

-continued

| List of Reference Numbers | |
|---|---|
| 24 | Third vent openings (second channel-outside) |
| 25 | End sealing |
| 26 | First longitudinal seam |
| 27 | Middle longitudinal seam |
| 28 | Third longitudinal seam |
| 29 | Sack |
| 30 | |
| 31 | Front of sack |
| 103 | Additional device |
| 102 | Tube former |
| 35 | Tube |
| 36 | Colling zone |
| 37 | Additional guide roll |
| 1 | Unwinder |
| 2 | Deflection roll |
| 3 | Air turner bar/deflection device |
| 4 | Driven advance roll |
| 5 | Conical die |
| 6 | Driven advance roll |
| 7 | Seam cooling roll |
| 8 | Breaking rolls |
| 9 | Winder |
| 10 | Film web/flat web |
| 11 | First gusset device |
| 12 | Gusset |
| 13 | Flat die |
| 14 | Longitudinal seam extruder |
| 15 | Opening of longitudinal seam extruder/outlet nozzle |
| 16 | |
| 17 | Squeeze rolls |
| 18 | Checking zone |
| 19 | Infrared measurement device |

What is claimed is:

1. A sack produced from a film tube, comprising:

an inner film layer and an outer film layer, at least a first vent channel and a second vent channel, the first and second vent channels being associated with a first, a second, and a third longitudinal sealing seam, the sack having a length in a direction of an axis (z) and a width in a direction of an axis (x), and the first and second vent channels extending substantially parallel to the axis (z) of the film tube, the inner film layer having first vent openings therein for venting an interior of the sack into the first vent channel, the first vent openings being configured as holes in the inner film layer, the first vent channel and the second vent channel being in communication via second vent openings for venting the first vent channel into the second vent channel, and the outer film layer having third vent openings therein for venting the second vent channel to an exterior of the sack, the third vent openings being configured as holes in the outer film layer, with the first vent openings and the third vent openings being located at substantially a same position relative to the length in the direction of the axis (z) of the sack, with each of the second vent openings being configured as an interruption in the second longitudinal sealing seam, the interruption being located at a treated portion of the film tube that is bond-resistant to an adhesive, the treated portion being a section of the film tube having a coating thereon, and with the first longitudinal sealing seam and the third longitudinal sealing seam each being without the interruptions over an entire longitudinal length of the seam.

2. The sack according to claim 1, further comprising a third vent channel that extends substantially orthogonal to the first and second vent channels.

3. The sack according to claim 2, wherein the third vent channel is provided on at least a first end of the sack, and wherein sealing of the sack at the first end thereof borders the third vent channel.

4. The sack according to claim 3, further comprising another third vent channel provided on a second end of the sack.

5. The sack according to claim 4, wherein the sack has at least one corner sealing, which, in the direction of the sack length axis (z), is positioned in front of the sack interior relative to the third vent channel.

6. The sack according to claim 1, further comprising gussets, and wherein the third vent openings lie in the direction of the sack width axis (x) in an area of the gussets.

7. The sack according to claim 1, wherein the exterior of the sack is the atmosphere.

8. The sack according to claim 1, wherein the treated portion of the film tube that is bond-resistant is electrically resistant to bonding.

9. The sack according to claim 1, wherein at least part of the first, second and third vent openings are equipped with filters.

10. The sack according to claim 1, wherein the coating is a sprayed-on layer having a chemical that prevents bonding.

11. The sack according to claim 1, wherein, in the direction of the sack length axis (z), at least one of the first vent openings, the second vent openings, and the third vent openings is spaced apart from others of the vent openings.

12. The sack according to claim 11, wherein at least two of the first vent openings, the second vent openings, and the third vent openings are spaced apart from each other, such that one of the first vent openings, the second vent openings, and the third vent openings lies on a front of the sack, and another of the first vent openings, the second vent openings, and the third vent openings lies on another side of the sack.

13. A method of producing a sack according to claim 1, comprising unwinding a film tube from an unwinding device and feeding the film tube to a machine that separates the film tube by cross-seals to film tube pieces, filling the sack formed during separation, and closing the filled sack with an additional transverse seal.

14. The method of producing a sack according to claim 13, wherein a film tube that already has at least two vent channels arranged next to each other that are arranged largely parallel to the film tube axis is unwound by the unwinding device.

15. The method of producing a sack according to claim 13, wherein a film tube, having a first vent channel (20), is unwound by the unwinding device and fed to a machine that makes transverse seals before filling, through which at least a second vent channel is formed.

16. The method of producing a sack according to claim 13, wherein a film tube is unwound that already has at least two substantially parallel vent channels.

* * * * *